US006565385B1

(12) United States Patent
Anderson et al.

(10) Patent No.: US 6,565,385 B1
(45) Date of Patent: May 20, 2003

(54) REDUCING ELECTROMAGNETIC EMISSIONS FROM A CONNECTOR COUPLED TO A PRINTED CIRCUIT BOARD

(75) Inventors: Michael G. Anderson, Littleton, MA (US); Ronald D. Lutz, Jr., Round Rock, TX (US)

(73) Assignee: Cisco Technology, Inc., San Jose, CA (US)

( * ) Notice: Subject to any disclaimer, the term of this patent is extended or adjusted under 35 U.S.C. 154(b) by 0 days.

(21) Appl. No.: 09/358,359

(22) Filed: Jul. 21, 1999

(51) Int. Cl.[7] ..... H01R 13/648
(52) U.S. Cl. ..... 439/607
(58) Field of Search ..... 439/607, 751, 439/947, 63

(56) References Cited

U.S. PATENT DOCUMENTS 4,230,385 A * 10/1980 Ammon et al. ..... 439/751
4,433,886 A * 2/1984 Cassarly et al. ..... 439/607
5,037,330 A * 8/1991 Fulponi et al. ..... 439/607
5,241,453 A * 8/1993 Bright et al. ..... 439/607
5,338,215 A * 8/1994 Lee et al. ..... 439/607
5,725,386 A * 3/1998 Davis et al. ..... 439/607
5,793,987 A 8/1998 Quackenbush et al. ..... 395/280
RE36,065 E * 1/1999 Andrews et al. ..... 439/608
5,934,940 A * 8/1999 Maranto et al. ..... 439/607
5,938,473 A * 8/1999 Nishio et al. ..... 439/607
5,940,959 A * 8/1999 Cavency et al. ..... 439/607
5,961,350 A * 10/1999 Shiu ..... 439/607
6,050,852 A * 4/2000 Wu ..... 439/607
6,113,427 A * 9/2000 Wu ..... 439/607

* cited by examiner

*Primary Examiner*—Javaid Nasri
(74) *Attorney, Agent, or Firm*—Baker Botts L.L.P.

(57) ABSTRACT

A connector for coupling a communication link to a printed circuit board includes a plurality of pins and a shield. The pins electrically couple the communication link to an interface on the printed circuit board and generate electromagnetic emissions when supplied with an electric current. The shield is displaced outwardly from the pins and prevents at least some of the electromagnetic emissions from radiating outside the connector. The shield includes a plurality of tabs that extend into the printed circuit board when the pins are electrically coupled to the interface.

33 Claims, 3 Drawing Sheets

REDUCING ELECTROMAGNETIC EMISSIONS FROM A CONNECTOR COUPLED TO A PRINTED CIRCUIT BOARD

TECHNICAL FIELD OF THE INVENTION

This invention relates generally to printed circuit boards and associated connectors and, more particularly, to reducing electromagnetic emissions from a connector coupled to a printed circuit board.

BACKGROUND OF THE INVENTION

Manufacturers of electronic devices frequently use printed circuit boards to mount resistors, capacitors, inductors, integrated circuits, and other electronic components. A printed circuit board generally provides electrical paths, called traces, that electrically couple to the electronic components mounted on the board. To communicate signals to external components, a printed circuit board typically includes one or more connectors that electrically couple traces within the printed circuit board to an external component using a communication link, such as a telecommunications cable.

Electromagnetic emissions from printed circuit boards generally, and from associated connectors in particular, create numerous problems for equipment operators and manufacturers. First, electromagnetic emissions from a connector may degrade the integrity of signals communicated within the printed circuit board and, consequently, may interfere with the operation of electronic components mounted on the printed circuit board. This interference is commonly known as crosstalk or feedback. Second, regulatory agencies, such as the Federal Communications Commission in the United States, often restrict electromagnetic emissions from electronic devices to ensure that emissions from one device do not interfere with the operation of other devices.

As technology advances, the electronic components mounted on printed circuit boards, as well as the traces within the printed circuit board, continue to decrease in size. In addition, printed circuit boards must increasingly communicate signals at higher frequencies. Due to these higher frequencies and the closer proximity of traces and electronic components, previous connectors for printed circuit boards are increasingly unable to limit electromagnetic emissions sufficiently to meet both the signal integrity and regulatory requirements. These and other deficiencies make previous printed circuit boards and associated connectors inadequate for many applications.

SUMMARY OF THE INVENTION

According to the present invention, disadvantages and problems associated with printed circuit boards and associated connectors have been substantially reduced or eliminated.

According to one embodiment, a connector for coupling a communication link to a printed circuit board includes a plurality of pins and a shield. The pins electrically couple the communication link to an interface on the printed circuit board and generate electromagnetic emissions when supplied with an electric current. The shield is displaced outwardly from the pins and prevents at least some of the electromagnetic emissions from radiating outside the connector. The shield includes a plurality of tabs that extend into the printed circuit board when the pins are electrically coupled to the interface.

According to another embodiment, a printed circuit board includes an interface and a plurality of openings. The interface electrically couples one or more traces to a plurality of pins on a connector, the interface and pins generating electromagnetic emissions when supplied with an electric current. The openings extend into the printed circuit board and are displaced outwardly from the interface. Each opening receives a corresponding tab of the connector when the pins are electrically coupled to the interface. The tabs prevent at least some of the electromagnetic emission from radiating outside the connector.

The present invention provides a number of important technical advantages. Unlike previous techniques, the present invention provides a connector including a shield with tabs that extend into an associated printed circuit board. The shield reduces electromagnetic emissions from the connector when the connector is coupled to the printed circuit board. First, because the tabs extend into the printed circuit board, the shield partially encloses the pins of the connector and prevents at least some of the electromagnetic emissions generated by electric currents through the pins from radiating outside the connector. Second, because the tabs may couple together ground planes within the printed circuit board, the shield may reduce any difference in voltage between the ground planes and prevent at least some electromagnetic emissions caused by ground current from radiating outside the connector. By reducing undesirable electromagnetic emissions from the connector, the present invention helps manufacturers avoid multiple design iterations and often costly product-level electromagnetic emission fixes, while allowing manufacturers and equipment operators to meet signal integrity and regulatory requirements. Other technical advantages are readily apparent to those skilled in the art.

BRIEF DESCRIPTION OF THE DRAWINGS

To provide a more complete understanding of the present invention, and further features and advantages thereof, reference is now made to the following description taken in conjunction with the accompanying drawings, in which:

FIGS. 1A through 1D illustrate an exemplary connector 10 according to the present invention. As shown in FIG. 1A, connector 10 includes any suitable number of pins 14, a shield 16, and a housing 18. In general, connector 10 couples traces or other electrical leads within a printed circuit board to an external component using a cable, wire, or other communication link 23. In a particular embodiment, connector 10 is a fifty-pin telecommunications connector, including twenty-five tip/ring pairs, and is suitable for coupling a telecommunications cable to a printed circuit board within a plain old telephone service (POTS) splitter or other appropriate telecommunications component.

DETAILED DESCRIPTION OF THE INVENTION

Figure 1A:
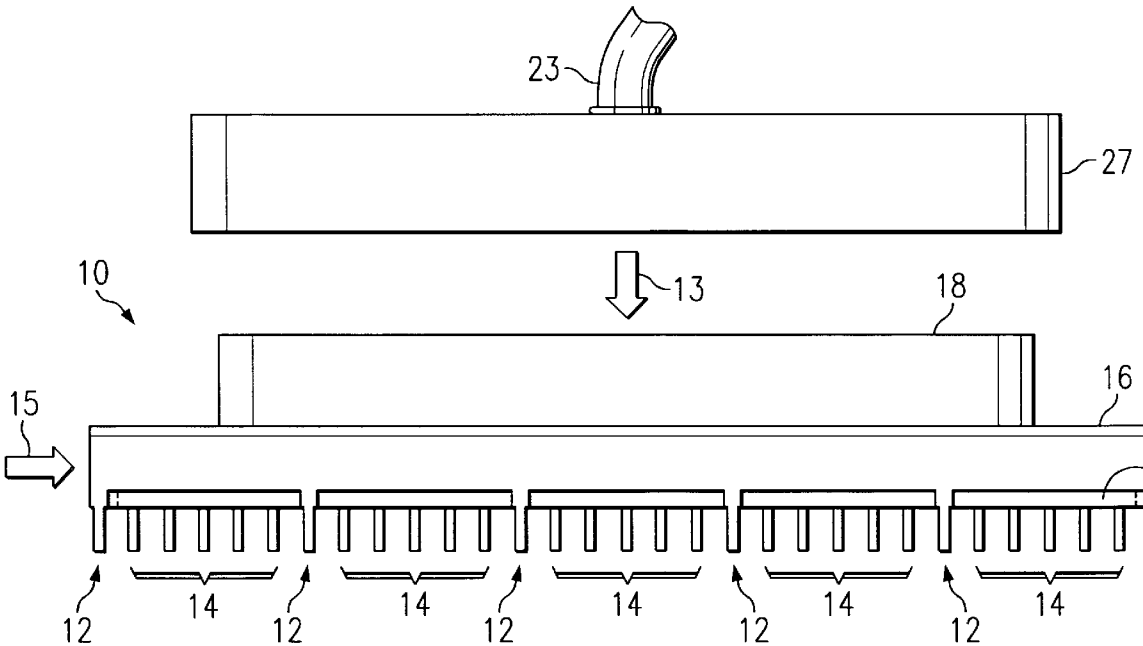
FIGS. 1A through 1D illustrate an exemplary connector according to the present invention.
Figure 1B:
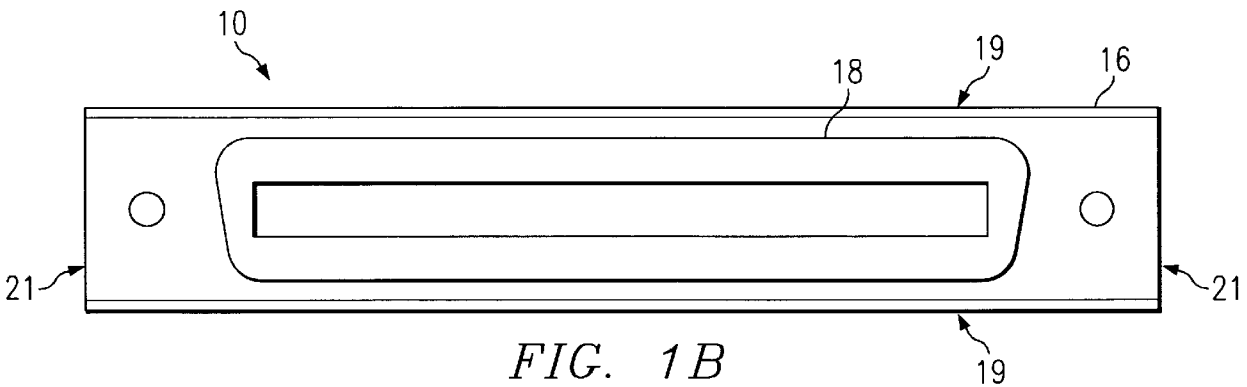
Figure 1C:
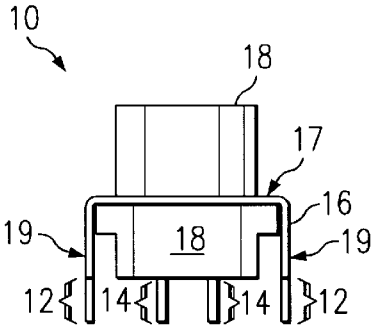

FIGS. 1A through 1C illustrate an exemplary connector 10 according to the present invention. As shown in FIG. 1A, connector 10 includes any suitable number of pins 14, a shield 16, and a housing 18. In general, connector 10 couples traces or other electrical leads within a printed circuit board to an external component using a cable, wire, or other communication link. In a particular embodiment, connector 10 is a fifty-pin telecommunications connector, including twenty-five tip/ring pairs, and is suitable for coupling a telecommunications cable to a printed circuit board within a plain old telephone service (POTS) splitter or other appropriate telecommunications component.

Pins 14 electrically couple to a corresponding interface on the printed circuit board. Pins 14 may either extend into the printed circuit board or electrically couple to conductive material on the surface of the printed circuit board. The interface electrically couples pins 14 to one or more traces or other electrical leads within the printed circuit board. Connector 10 may include any number of pins 14 of one or more suitable shapes. When coupled to the interface and supplied with an electric current, pins 14 generally radiate at least some undesirable electromagnetic emissions in one or more directions.

Housing 18 secures pins 14 in a particular arrangement so that pins 14 may properly and consistently couple to the interface on the printed circuit board. Although housing 18 secures pins 14 in two parallel rows in FIG. 1C, housing 18 may secure pins 14 in any suitable linear, circular, or other arrangement according to the interface on the printed circuit board. In a particular embodiment, connector 10 is more or less permanently fixed to the printed circuit board, and housing 18 removably fastens to a matching connector 27 that is itself attached to a cable, wire, or other communication link 23. In another embodiment, connector 10 may be more or less permanently attached to a cable, wire, or other communication link 23 and removably fasten to the printed circuit board.

In operation, shield 16 prevents at least some electromagnetic emissions from pins 14 from radiating outside connector 10. Shield 16 is displaced outwardly from at least some pins 14 and includes an appropriate number of tabs 12 of one or more appropriate shapes. In a particular embodiment, shield 16 is composed of spring or half-hardened steel with tin, nickel, or other suitable plating that is compatible with the printed circuit board. Although shield 16 is shown as a single substantially integral piece, the present invention contemplates shield 16 including multiple pieces to provide the described functionality.

Tabs 12 extend at least into the printed circuit board when pins 14 are electrically coupled to the interface on the printed circuit board. In a particular embodiment, tabs 12 may extend entirely through the printed circuit board. Because tabs 12 extend at least into the printed circuit board, shield 16 partially encloses pins 14 and prevents at least some electromagnetic emissions from pins 14 from radiating outside connector 10. In addition, as described in further detail below, tabs 12 may couple together two or more ground planes within the printed circuit board. By reducing or eliminating any differences in voltage between the ground planes, tabs 12 decrease electromagnetic emissions caused by associated ground currents and further reduce total emissions from connector 10.

At least some tabs 12 are separated from one another so that one or more traces within the printed circuit may pass between tabs 12 when tabs 12 extend into the printed circuit board. In a particular embodiment, tabs 12 may be separated from one another by approximately 0.1 inches to approximately 0.5 inches and at least two traces may pass between adjacent tabs 12 in an appropriate layer of the printed circuit board. Spacing of tabs 12 may be determined according to the frequency of the emissions sought to be contained within connector 10. In a particular embodiment, tabs 12 are spaced such that shield 16 reduces undesirable electromagnetic emissions radiating from connector 10 at one, some, or all frequencies less than approximately 2 GHz. Tabs 12 may be separated by any appropriate distance according to the particular application in which connector 10 will be used.

In a particular embodiment, tabs 12 press-fit into the printed circuit board to avoid complications that might otherwise be associated with soldering connector 10 to the printed circuit board. Because soldering typically involves substantial temperature changes, soldering connectors to printed circuit boards may warp the printed circuit boards or damage components mounted on the printed circuit boards. In addition, soldering frequently results in cracked joints between connectors and printed circuit boards or in other latent defects that may interfere with an electronic device's reliability. By avoiding the need to solder connector 10 to the printed circuit board, press-fit tabs 12 help reduce or eliminate these problems and may reduce manufacturing time and costs.

Figure 1D:
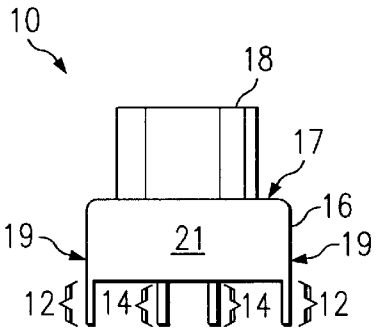

FIGS. 1B and 1C illustrate connector 10 viewed in the direction of arrow 13 and arrow 15, respectively, in FIG. 1A. In one embodiment, as shown, top 17 and lateral sides 19 of shield 16 cooperate to substantially surround pins 14. Shield 16 may also extend wholly or partially across ends 21 of connector 10 to help substantially surround pins 14. The present invention contemplates shield 16 surrounding some or all pins 14 using top 17, lateral sides 19, and ends 21, in any suitable combination. As a result, shield 16 may form up to a five-sided enclosure, called a "Faraday package," that substantially surrounds pins 14. This enclosure prevents at least some electromagnetic emissions generated by electric currents through pins 14 from radiating outside connector 10. As described below, a ground plane within the printed circuit board may effectively act as a bottom side of the enclosure to form, in cooperation with shield 16, a six-sided Faraday package. FIG. 1D illustrates shield 16 extending across end 21 of connector 10 to help substantially surround pins 14, viewed in the direction of arrow 15 in FIG. 1A.

Figure 2:
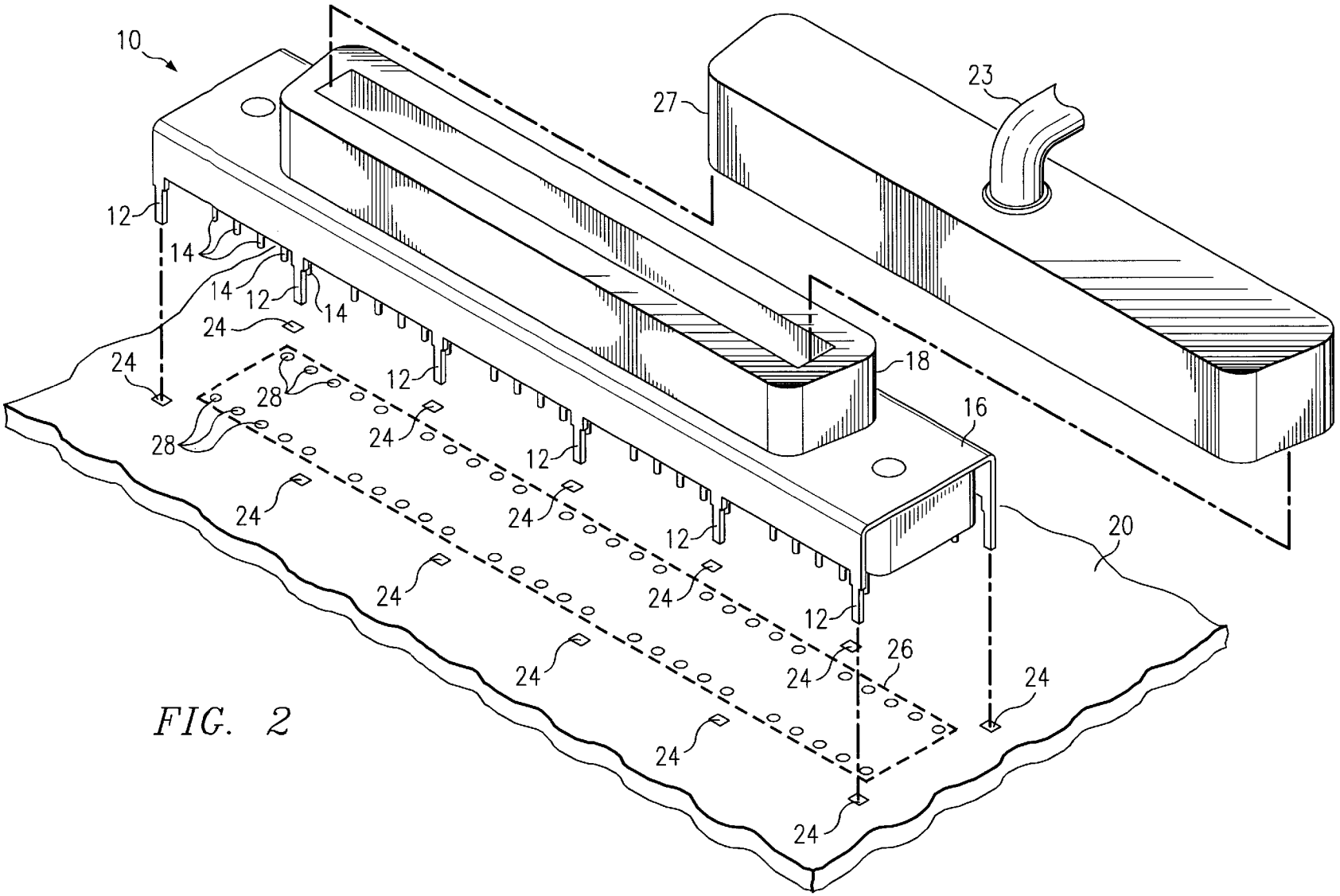
FIG. 2 illustrates an exemplary connector coupling to a printed circuit board according to the present invention.

FIG. 2 illustrates connector 10 and an associated printed circuit board 20 according to the present invention. As described above, connector 10 includes pins 14, shield 16, and housing 18. Printed circuit board 20 includes a plurality of openings 24 and an interface 26.

Openings 24 receive corresponding tabs 12 of connector 10. The number and shapes of openings 24 generally correspond to the number and shapes of tabs 12 of connector 10. Openings 24 extend at least partially into printed circuit board 20 and are displaced outwardly from interface 26. Like tabs 12, openings 24 may be separated from one another so that one or more traces within printed circuit 20 may pass between openings 24. The traces couple one or more electronic components mounted to the printed circuit board to interface 26. In a particular embodiment, openings 24 may be separated from one another by approximately 0.1 inches to approximately 0.5 inches, and at least two traces may pass between adjacent openings 24 in an appropriate layer of printed circuit board 20. In a particular embodiment, one or more openings 24 may receive tabs 12 that press-fit into printed circuit board 20. As explained above, press-fit tabs 12 help avoid problems that might otherwise be associated with soldering connector 10 to printed circuit board 20 and may reduce manufacturing time and costs.

Interface 26 includes links 28 that electrically couple corresponding pins 14 to one or more traces within printed circuit board 20. Links 28 may be either apertures that extend into printed circuit board 20 or conductive material located on the surface of printed circuit board 20. The number and shapes of links 28 generally correspond to the number and shapes of pins 14 of connector 10. When connector 10 is coupled to printed circuit board 20, at least some pins 14 and links 28 may be supplied with an electric current and, as a result, radiate at least some undesirable electromagnetic emissions. Shield 16 at least partially encloses pins 14 and links 28 and prevents at least some electromagnetic emissions from pins 14 and links 28 from radiating outside connector 10 and interface 26.

Figure 3:
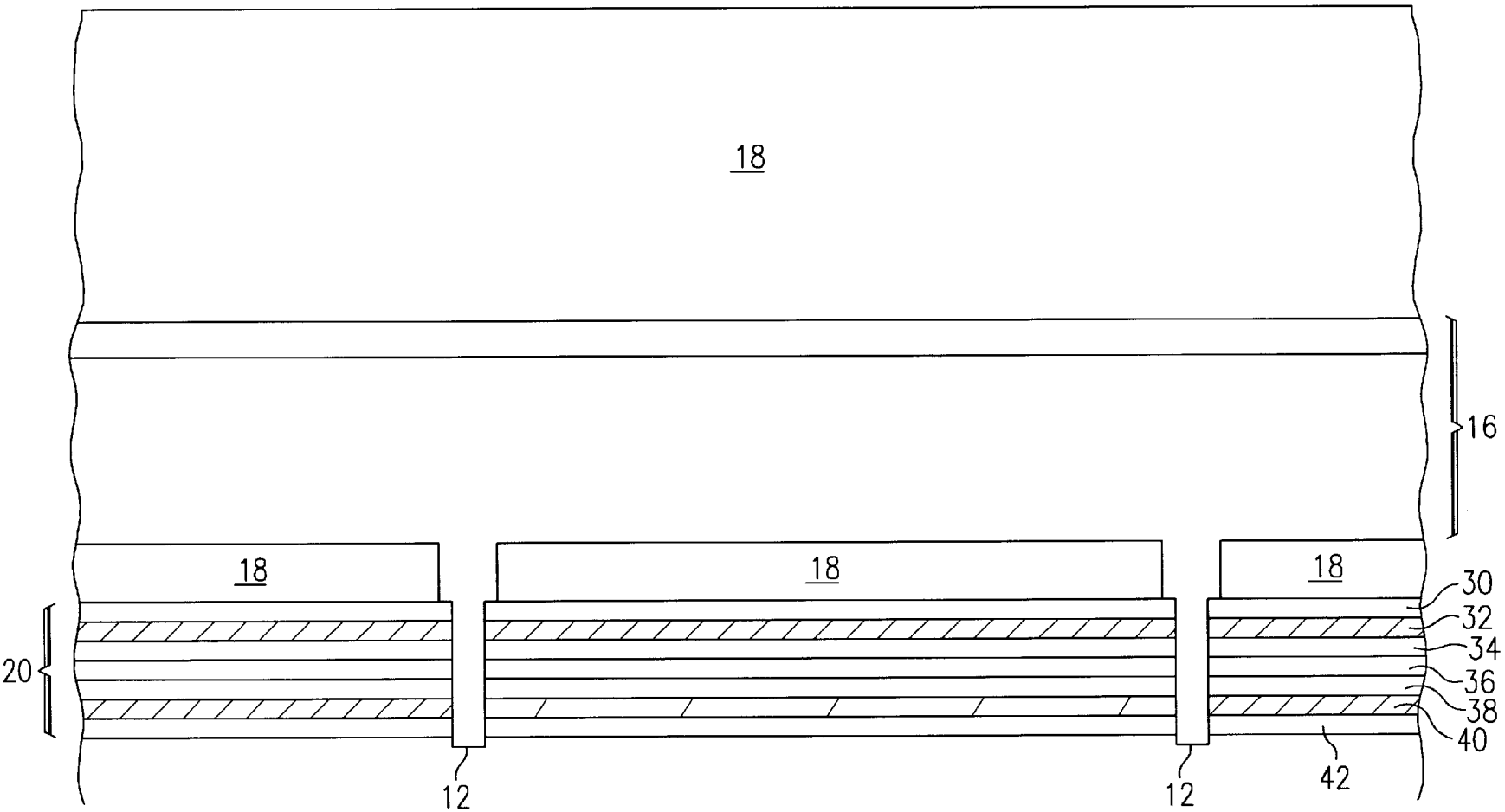
FIG. 3 illustrates a portion of an exemplary connector coupled to a printed circuit board according to the present invention.

FIG. 3 illustrates a portion of connector 10 coupled to printed circuit board 20. In the exemplary arrangement shown in FIG. 3, printed circuit board 20 includes multiple layers 30, 32, 34, 36, 38, 40, and 42. Layers 30, 32, 34, 36, 38, 40, and 42 are typically alternating layers of relatively conductive and relatively insulative material. In a particular embodiment, outside layers 30 and 42 each include a solder mask or other suitable protective layer, layers 32 and 40 include tin-plated copper or any other suitable conductor, layers 34 and 38 include a suitable dielectric (such as FR-4 fiberglass), and layer 36 includes copper or another suitable conductor. Printed circuit board 20 may include any suitable number of alternating layers of relatively conductive and relatively insulative material according to particular needs.

In a particular embodiment, layers 32 and 40 are ground planes within printed circuit board 20. Generally, local differences in voltage within ground planes 32 and 40 result in ground current that creates undesirable electromagnetic emissions. Tabs 12 may each provide a connection to electrically couple ground planes 32 and 40 to one another. By tying ground planes 32 and 40 to a common reference, tabs 12 reduce any differences in voltage within ground planes 32 and 40 and therefore reduce electromagnetic emissions caused by associated ground currents. In addition, ground plane 40 effectively acts as the bottom side of shield 16. As a result, shield 16, including tabs 12, and ground plane 40 cooperate to form a six-sided enclosure or "Faraday package" that substantially surrounds pins 14 and interface 26. This enclosure prevents at least some electromagnetic emissions from pins 14 and interface 26 from radiating outside connector 10 or from radiating through the side of printed circuit board 20 opposite connector 10. As described above, even if tabs 12 do not extend through printed circuit board 20 and electrically couple to ground plane 40, shield 16 still forms a Faraday package that substantially surrounds pins 14 and interface 26 and prevents at least some electromagnetic emissions from pins 14 and interface 26 from radiating outside connector 10.

Although the present invention has been described with several embodiments, a person skilled in the art could make various alterations, modifications, and additions without departing from the spirit and scope of the present invention as defined by the appended claims.

What is claimed is:

1. A connector for coupling a communication link to a printed circuit board, comprising:

a housing operable to fasten to a matching connector along an axis, the matching connector coupled to a communication link;

a plurality of pins secured by the housing in alignment with the axis and operable to electrically couple the communication link to an interface on the printed circuit board and to generate electromagnetic emissions when supplied with an electric current; and a shield displaced outwardly from the pins and operable to prevent at least some of the electromagnetic emissions from radiating outside the connector, the shield comprising a plurality of tabs operable to extend into the printed circuit board when the pins are electrically coupled to the interface, the tabs substantially surrounding the pins, at least some tabs further operable to press-fit into the printed circuit board, wherein at least two adjacent tabs are separated from one another by approximately 0.1 inches to approximately 0.5 inches.

2. The connector of claim 1, wherein one or more tabs are further operable to electrically couple at least two ground planes within the printed circuit board to one another.

3. The connector of claim 1, wherein a separation between at least two of the tabs is operable to accommodate one or more traces within the printed circuit board and coupled to the interface.

4. The connector of claim 1, wherein the tabs substantially surround the pins on two or more sides of the connector.

5. The connector of claim 3, wherein the separation between the tabs is determined based on a desired frequency of electromagnetic emissions to be prevented from radiating outside the connector by the shield.

6. The connector of claim 1, wherein the matching connector permanently attaches to the housing.

7. The connector of claim 1, wherein:

the shield comprises first lateral sides and second lateral sides, the first lateral sides longer than the second lateral sides; and the plurality of tabs comprises at least one intermediate tab along each first lateral side, the intermediate tab positioned between two other tabs, each of the other tabs positioned at an end of one of the first lateral sides.

8. The connector of claim 1, wherein at least some tabs extend entirely through the printed circuit board.

9. The connector of claim 1, wherein one or more tabs are further operable to electrically couple to one or more ground planes within the printed circuit board.

10. The connector of claim 1, wherein one or more tabs are further operable to electrically couple at least two ground planes within the printed circuit board to one another.

11. A connector for coupling a communication link to a printed circuit board, comprising:

a housing operable to fasten to a matching connector along an axis, the matching connector coupled to a communication link;

a plurality of pins secured by the housing in alignment with the axis and operable to electrically couple the communication link to an interface on the printed circuit board and to generate electromagnetic emissions when supplied with an electric current; and a shield displaced outwardly from the pins and operable to prevent at least some of the electromagnetic emissions from radiating outside the connector, the shield comprising a plurality of tabs operable to extend into the printed circuit board when the pins are electrically coupled to the interface, the tabs substantially surrounding the pins, at least some tabs further operable to press-fit into the printed circuit board, wherein the shield is operable to substantially prevent the electromagnetic emissions from radiating outside the connector at one or more frequencies less than approximately 2.0 gigahertz.

12. The connector of claim 11, wherein at least some tabs extend entirely through the printed circuit board.

13. The connector of claim 11, wherein one or more tabs are further operable to electrically couple to one or more ground planes within the printed circuit board.

14. The connector of claim 11, wherein one or more tabs are further operable to electrically couple at least two ground planes within the printed circuit board to one another.

15. A method for manufacturing a connector for coupling a communication link to a printed circuit board, comprising:

forming a housing operable to couple to a matching connector along an axis, the matching connector coupled to a communication link;

arranging a plurality of pins aligned with the axis and operable to electrically couple the communication link to an interface on the printed circuit board, wherein the pins generate electromagnetic emissions when supplied with an electric current;

placing a shield operable to prevent at least some of the electromagnetic emissions from radiating outside the connector, the shield comprising a top interposed between the matching connector and the pins and further comprising lateral sides, the lateral sides comprising a plurality of tabs substantially surrounding the pins and operable to extend and press-fit into the printed circuit board when the pins are electrically coupled to the interface; and forming the shield such that the tabs are further operable to be press-fit into the printed circuit board, wherein the shield is operable to substantially prevent the electromagnetic emissions from radiating outside the connector at one or more frequencies less than approximately 2.0 gigahertz.

16. The method of claim 15, further comprising forming the shield such that one or more tabs are further operable to electrically couple to one or more ground planes within the printed circuit board.

17. The method of claim 15, further comprising forming the shield such that one or more tabs are further operable to electrically couple at least two ground planes within the printed circuit board.

18. The method of claim 15, wherein the tabs substantially surround the pins on two or more sides of the connector.

19. The method of claim 15, wherein:

the lateral sides comprise first lateral sides and second lateral sides, the first lateral sides longer that the second lateral sides; and the plurality of tabs comprises at least one intermediate tab along each first lateral side, the intermediate tab positioned between two other tabs, each of the other tabs positioned at an end of one of the first lateral sides.

20. A method for manufacturing a connector for coupling a communication link to a printed circuit board, comprising:

forming a housing operable to couple to a matching connector along an axis, the matching connector coupled to a communication link;

arranging a plurality of pins aligned with the axis and operable to electrically couple the communication link to an interface on the printed circuit board, wherein the pins generate electromagnetic emissions when supplied with an electric current;

placing a shield operable to prevent at least some of the electromagnetic emissions from radiating outside the connector, the shield comprising a top interposed between the matching connector and the pins and further comprising lateral sides, the lateral sides comprising a plurality of tabs substantially surrounding the pins and operable to extend and press-fit into the printed circuit board when the pins are electrically coupled to the interface; and forming the shield such that the tabs are further operable to be press-fit into the printed circuit board and such that at least two adjacent tabs are separated from one another by approximately 0.1 inches to 0.5 inches.

21. The method of claim 20, further comprising forming the shield such that one or more tabs are further operable to electrically couple to one or more ground planes within the printed circuit board.

22. The method of claim 20, further comprising forming the shield such that one or more tabs are further operable to electrically couple at least two ground planes within the printed circuit board.

23. A connector for coupling a communication link to a printed circuit board, comprising:

a housing having a first portion and a second portion, the first portion operable to receive a communication link along an axis;

a plurality of pins secured in a particular arrangement by the second portion of the housing and extending from the second portion of the housing in the direction of the axis, the plurality of pins operable to couple the communication link electrically to an interface on a printed circuit board, wherein the pins generate electromagnetic emissions when supplied with an electric current; and a shield comprising a top and lateral sides operable to prevent at least some of the electromagnetic emissions from radiating outside the connector, the top of the shield interposed between the first and second portions of the housing, the lateral sides comprising tabs substantially surrounding the pins and configured to extend and press-fit into the printed circuit board when the pins are electrically coupled to the interface, wherein the shield is operable to substantially prevent the electromagnetic emissions from radiating outside the connector at one or more frequencies less than approximately 2.0 gigahertz.

24. The connector of claim 23, wherein the pins are wholly enclosed within a perimeter defined by the tabs.

25. The connector of claim 23, wherein the tabs are further operable to couple to one or more ground planes within the printed circuit board.

26. The connector of claim 25, wherein the shield forms a five-sided Faraday package around the pins and one of the ground planes acts as a sixth side to the Faraday package.

27. The connector of claim 23, wherein distances between the tabs are selected to accommodate one or more traces on the printed circuit board and to prevent a substantial portion of electromagnetic emissions of a desired frequency from radiating outside the connector.

28. The connector of claim 23, wherein:

the lateral sides comprise first lateral sides and second lateral sides, the first lateral sides longer that the second lateral sides; and the plurality of tabs comprises at least one intermediate tab along each first lateral side, the intermediate tab positioned between two other tabs, each of the other tabs positioned at an end of one of the first lateral sides.

29. A connector for coupling a communication link to a printed circuit board, comprising:

a housing operable to fasten to a matching connector along an axis, the matching connector coupled to a communication link;

a plurality of pins secured by the housing in alignment with the axis and operable to electrically couple the communication link to an interface on the printed circuit board and to generate electromagnetic emissions when supplied with an electric current; and a shield displaced outwardly from the pins and operable to prevent at least some of the electromagnetic emissions from radiating outside the connector, the shield comprising a plurality of tabs operable to extend into the printed circuit board when the pins are electrically coupled to the interface, the tabs substantially surrounding the pins, at least some tabs further operable to press-fit into the printed circuit board, wherein at least two adjacent tabs are separated from one another by approximately 0.1 inches to approximately 0.5 inches, a separation between at least two of the tabs is operable to accommodate one or more traces within the printed circuit board and coupled to the interface, and the shield is operable to substantially prevent the electromagnetic emissions from radiating outside the connector at one or more frequencies less than approximately 2.0 gigahertz.

30. A connector for coupling a communication link to a printed circuit board, comprising:

a housing having a first portion and a second portion, the first portion operable to receive a communication link along an axis;

a plurality of pins secured in a particular arrangement by the second portion of the housing and extending from the second portion of the housing in the direction of the axis, the plurality of pins operable to couple the communication link electrically to an interface on a printed circuit board, wherein the pins generate electromagnetic emissions when supplied with an electric current; and a shield comprising a top and lateral sides operable to prevent at least some of the electromagnetic emissions from radiating outside the connector, the top of the shield interposed between the first and second portions of the housing, the lateral sides comprising tabs substantially surrounding the pins and configured to extend and press-fit into the printed circuit board when the pins are electrically coupled to the interface, wherein at least two adjacent tabs are separated from one another by approximately 0.1 inches to approximately 0.5 inches.

31. The connector of claim 30, wherein the pins are wholly enclosed within a perimeter defined by the tabs.

32. The connector of claim 30, wherein the tabs are further operable to couple to one or more ground planes within the printed circuit board.

33. The connector of claim 30, wherein the shield forms a five-sided Faraday package around the pins and one of the ground planes acts as a sixth side to the Faraday package.

* * * * *